United States Patent [19]

Solovieff

[11] Patent Number: 4,664,433

[45] Date of Patent: May 12, 1987

[54] LATCH HELICAL BACKSET ADJUSTMENT

[75] Inventor: Paul Solovieff, Tustin, Calif.

[73] Assignee: Kwikset Corporation, Anaheim, Calif.

[21] Appl. No.: 861,832

[22] Filed: May 12, 1986

[51] Int. Cl.[4] ..... E05C 1/16

[52] U.S. Cl. ..... 292/337; 292/DIG. 60; 292/173

[58] Field of Search ..... 292/1, 337, DIG. 44, 292/DIG. 60, 173

[56] References Cited

U.S. PATENT DOCUMENTS

| | | | |
|---|---|---|---|
| 294,560 | 3/1884 | Woodrich et al. . | |
| 365,152 | 6/1887 | Simson . | |
| 1,661,454 | 8/1926 | Wilson . | |
| 1,672,076 | 1/1924 | Munson . | |
| 2,586,066 | 6/1948 | Larson | 292/182 |
| 2,822,202 | 2/1958 | Welch | 292/337 X |
| 2,937,897 | 1/1958 | Soderberg | 292/1 |
| 4,372,594 | 2/1983 | Gater | 292/337 |

*Primary Examiner*—Richard E. Moore

*Attorney, Agent, or Firm*—Barry E. Deutsch

[57] ABSTRACT

The door latch construction is of the usual type wherein a bolt is reciprocal in a casing between extended and projecting positions with latch operating means forwardly operably connected to the bolt for causing such motion. In such latch construction, the longitudinal distance between the forward extremity of the casing and the operator axis constitutes backset. According to the present invention, the casing and bolt are each comprised of relatively longitudinally movable forward and rearward parts with a substantially helical slot on one of the parts and engaged by a projection on the other of the parts in each case. The slot and projection of each provides helical longitudinal movement for each of the determined same amount between a forward backset and a rearward backset, with interconnection means between certain of the bolt parts and certain of the casing parts for requiring substantially the same helical longitudinal movement of one upon such movement of the other. Otherwise, the bolt is reciprocal relative to the casing in either of the forward and rearward backsets. The bolt and casing interconnection means may be common formation permitting longitudinal movement but not permitting relative rotational movement. Furthermore, the casing helical slot may be formed at either end to retard movement over the bolt helical slot, resiliently urged stops may be installed to stop helical slot movement at either end of movement, and anti-adjustment projections may be installed only permitting helical slot movement when the bolt is in extended position.

22 Claims, 17 Drawing Figures

LATCH HELICAL BACKSET ADJUSTMENT

BACKGROUND OF THE INVENTION

This invention relates to a somewhat usual latch construction having a unique form of helical backset adjustment therein and more particularly, to such a latch construction having the helical backset adjustment which is of a maximum simplicity and form, and which operates in an extremely simple manner without any fear of error. Furthermore, the latch construction having the unique form of helical basket adjustment therein may be formed of usual materials with only slight increases in cost. Thus, an improved, adjustable latch construction is provided which perfectly serves the intended purposes in an efficient manner not possible with the prior construction.

In the various latch constructions of the type used with doors and the like, the backset measurement thereof is that distance between the forward extremities of the stationary casing longitudinally rearwardly to the transverse axis about which the latch operator moves for extending and retracting the bolt of the latch construction. These measurements have, in most modern latch constructions, been standardized by the industry. With this standardization, it is known that when a latch construction is purchased, the backset measurement will be a standard amount and from a practical standpoint, this measurement will be calculated from the forward exposed surface of the latch mounting plate which, in effect, is the forward extremity of the stationary frame or casing. Again, in a usual installation, the face plate forming the forward part of the casing is recessed in the door edge with the front surface of the face plate aligned with the door edge. Thus, in most cases, the backset measurement is also the distance from the door edge to the axis of the latch operator.

In modern industry, the most prevalent backset has been standardized at two and three eights inches so that it has normally been known prior to latch construction installation what the backset measurement would be. This premits standardized original installation and a high degree of interchangeability between various latch constructions. It is true that there have been a few "special" latch constructions having "special" backset measurements, but these have always been considered different and of no overall consequences, except requiring individual considerations for proper installation. However, more recently, a higher and higher percentage of latch constructions are being produced with greater backset measurement for various reasons including the provision of greater longitudinal length to gain increased bolt throw, that is, the longitudinal distance that the bolt is moved between retracted and extended position, in order to, in turn, provide increased security.

In view of this intended increased security, and increased backset measurement standard has now been adopted by the industry. This second standard being two and three quarters inches, three eights inches greater than the previous common standard backset. In most cases, the average manufacturer of latch constructions has satisfied this new demand for the alternate two backset measurements by producing and marketing two different and distinct models of any of the latch constructions. The one model has a backset measurement of two and three eights inches to satisfy the demand for the old standard backset, while the other model has the new standard backset of two and three quarters inches, all of which is relatively costly in view of the need for manufacturing multiple models.

Thus, there became a distinct want and need in the industry for single models of latch constructions which are relatively quickly and easily selectively adjustable between the two standard backset measurements, that is, between two and three eights inches and two and three quarters inches. Furthermore, such adjustability must be of a relatively simple nature for performance of the backset adjustment quickly and easily by relatively unskilled workmen. Various of the manufacturers have produced such single models of latch constructions which satisfy the backset adjustment feature, but none of such constructions have been of a satisfactory nature. For this reason, this distinct want and need in the industry for such a construction has persisted not only for such a construction which operates satisfactorily to carry out its required adjustment, but also one which is ralatively economical to produce.

OBJECTS AND SUMMARY OF THE INVENTION

It is, therefore, an object of this invention to provide a latch construction of the type for doors and the like which is easily adjustable between at least two backset positions and which makes use of two helical slot and projection arrangements, one in each of the bolt and casing, which are tied together in a unique manner for simultaneous movement, that is, movement of one in a generally helical path causing similar movement of the other. It is preferred that both the bolt and casing be formed of two parts each, the bolt parts telescoping and the casing parts telescoping. Furthermore, it is preferred that the forward part of the bolt will be telescoped by the forward part of the casing and that these two parts will have mating outside shapes so arranged so that the bolt and casing will be longitudinally movable together but not rotatable one to the other. This thereby accomplishes the simultaneous adjustment movement.

It is a further object of this invention to provide a latch construction for mounting in doors and the like having the foregoing helical slot and projection arrangement which operates in a highly efficient manner, yet the preferred backset adjustment thereof is merely by grasping the latch construction prior to installation in the door in which it will serve and twisting the same in a rotative manner. The result is that there is a quick and efficient adjustment to the intended backset thereof. Furthermore, the person carrying out the same need not be of a particular mechanical dexterity, at least as far as doors and doorlatches are concerned, yet the same will be accomplished in a smooth and efficient manner.

It is still a further object of the present invention to provide a latch construction for mounting in doors and the like which satisfies one or both of the foregoing objects in an efficient manner, yet which may have added thereto an improved helical slot arrangement which insures the proper slot and projection operation without the chance of missed timing, one with the other. Particularly, it is preferred that the outer casing helical slot will have the lesser backset end portion thereof and the bolt helical slot will have the greater backset end portion thereof each flattened to assume flat or straight radial. This results in, when starting from the lesser backset adjustment, the bolt moves outward first while the casing is slightly delayed. The opposite occurs in moving from maximum to minimum backset. The overall result is to insure that accidental overlapping of part movement or slight misalignments, which could trap the bolt, cannot ever take place. Thus, again, the overall helical slot and projection arrangement must always operate in a smooth and efficient manner.

It is also an object of this invention to provide a latch construction for mounting in doors and the like which also satisfies one or all of the foregoing objects, yet the latch construction may preferably still further include various additional improvements adding to the overall enhancement. One preferred enhancement may be the provision of resiliently urged stops at either extremity of backset adjustment movement to define the ends of such movement in a simple manner. Another possibility of enhancement, if desired, may be the provision of anti-adjustment projection means positioned on the inner of the casing parts and bearing against one of the bolt parts when the latch construction is in the retracted position preventing backset adjustment until the latch construction is moved to its extended position. This thereby eliminates possible interference between the bolt and casing parts which can occur in the retracted position, this again, being another form of construction insuring smooth and efficient operation.

Other objects and advantages of the invention will be apparent from the following specification and the accompanying drawings which are for the purpose of illustration only.

BRIEF DESCRIPTION OF THE DRAWINGS

FIG. 15 is a perspective view showing the forward part of the casing looking along the arrows 15—15 in FIG. 14;

DESCRIPTION OF THE BEST EMBODIMENTS CONTEMPLATED

Figure 1:
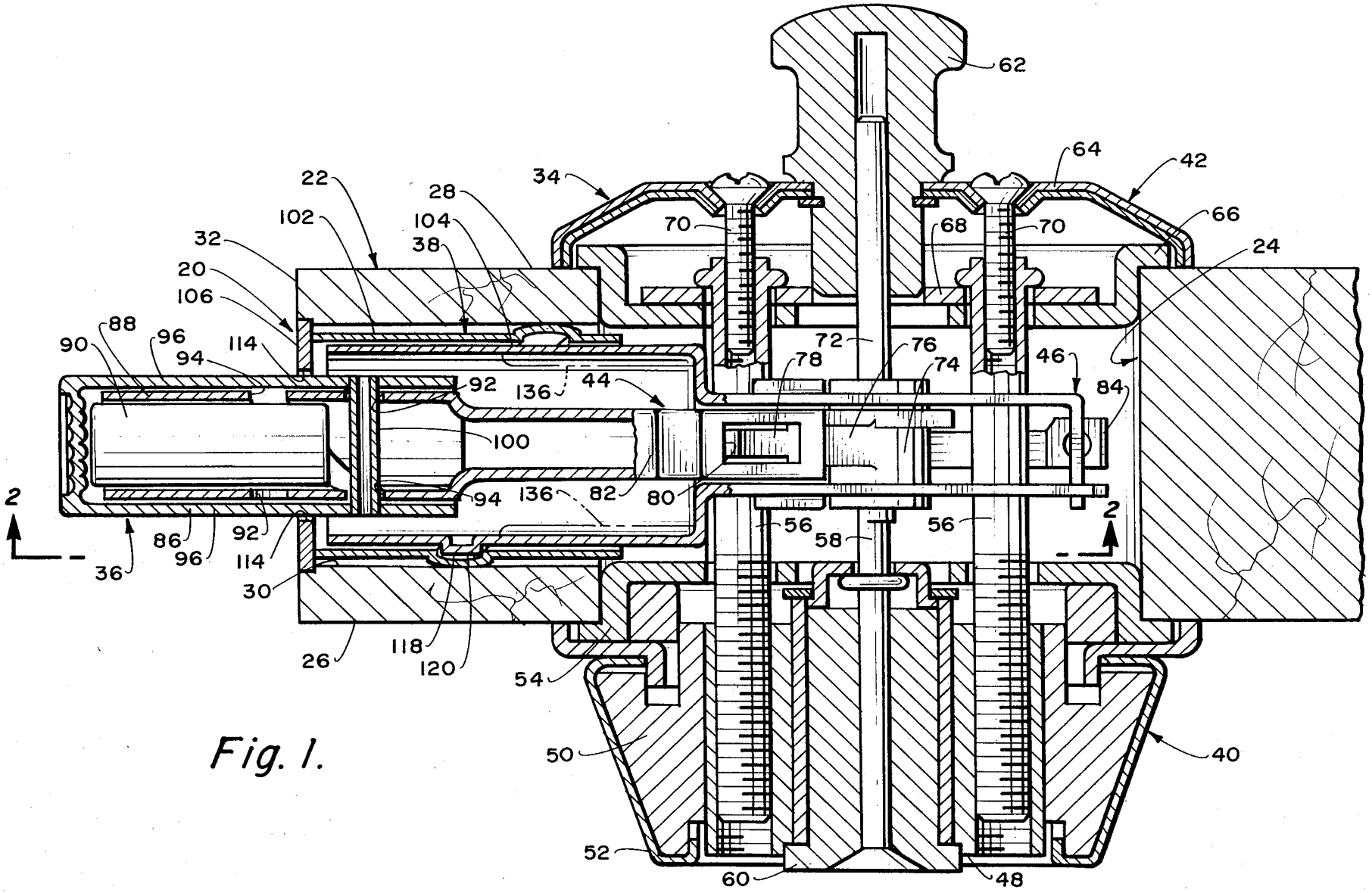
FIG. 1 is a horizontal sectional plan view of a typical latch construction mounted in a door and incorporating a preferred embodiment of the backset adjustment principles of the present invention, the latch construction being shown in bolt extended position and the backset adjustment being shown in minimum backset adjustment.
Figure 2:
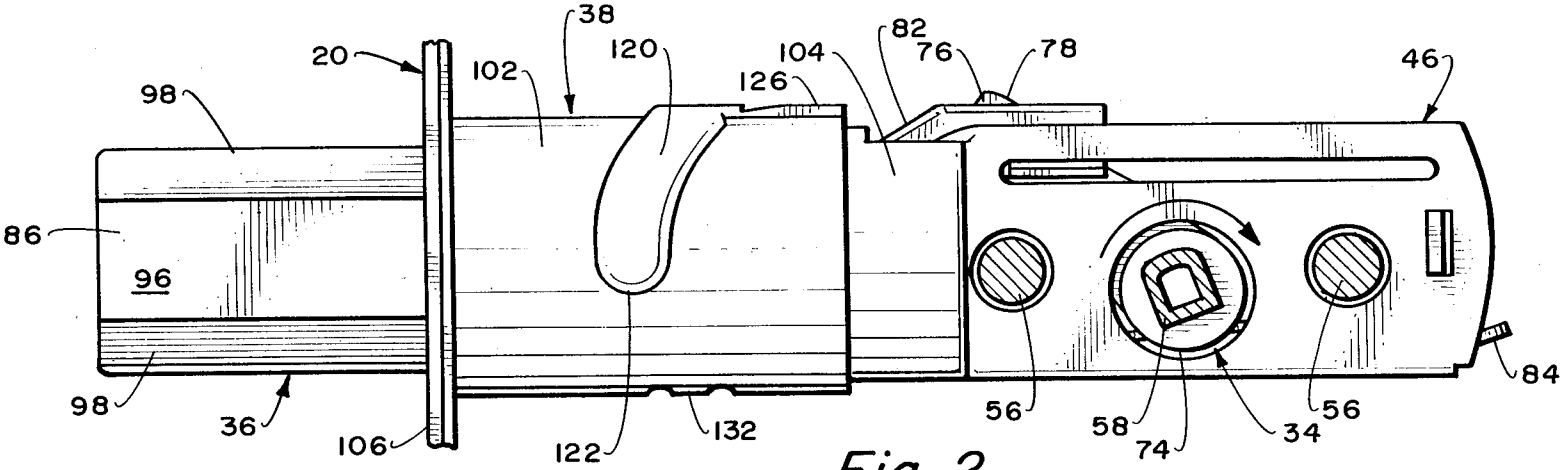
FIG. 2 is a longitudinal vertical sectional view to show the latch construction apart from the door and looking in the direction of the arrows 2—2 in FIG. 1.
Figure 3:
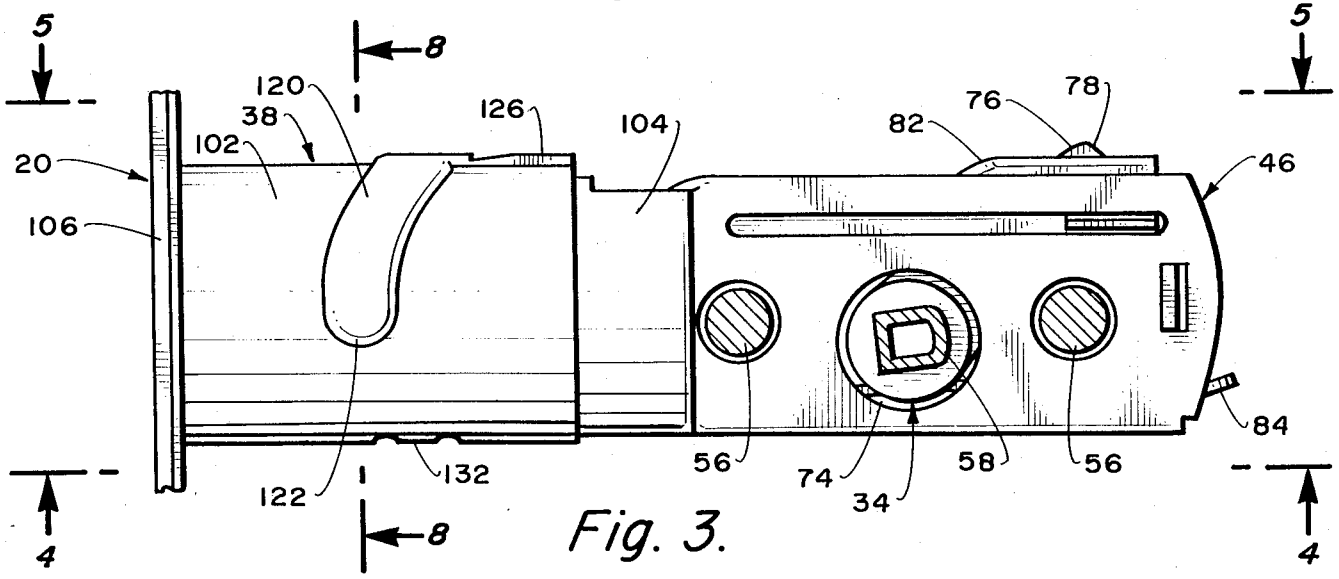
FIG. 3 is a longitudinal vertical sectional view similar to FIG. 2, but with the bolt in fully retracted position.
Figure 4:
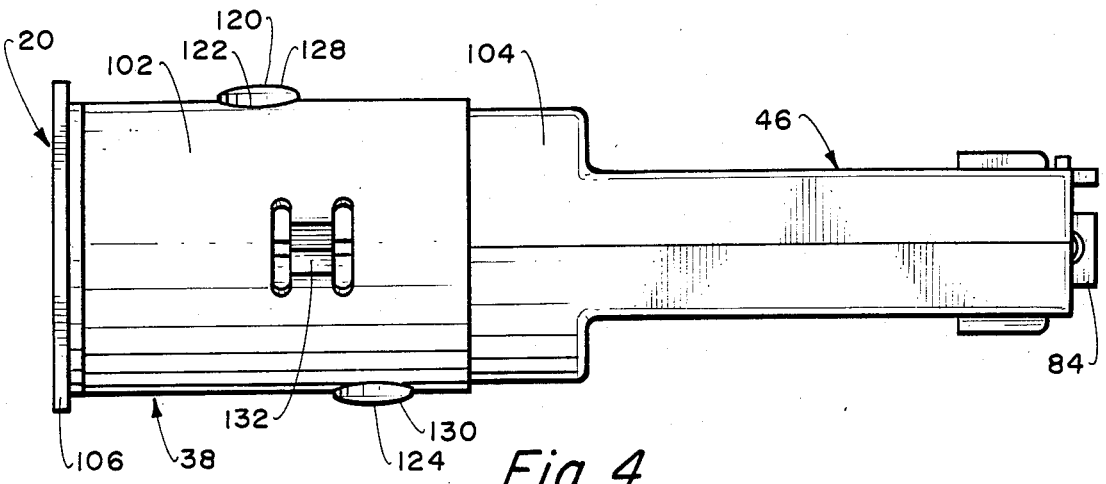
FIG. 4 is a longitudinal bottom plan view looking in the direction of the arrows 4—4 in FIG. 3.
Figure 5:
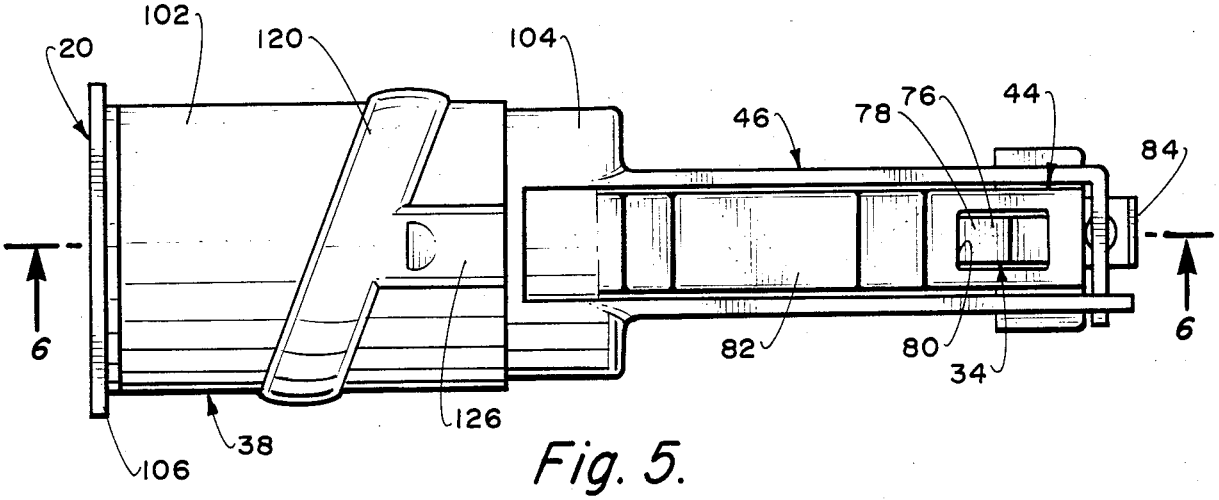
FIG. 5 is a longitudinal top plan view looking in the direction of the arrows 5—5 in FIG. 3.

Referring to the drawings, the backset adjustment principles of the present invention are shown incorporated in a typical form of latch construction. However, it is pointed out that the backset adjustment principles are not confined to this latch construction alone, but may be incorporated in other known latch constructions operating in different manners as desired. Furthermore, the latch constructions and the backset adjustment principles of the present invention may be fabricated by usual manufacturing methods and using usual materials, all well known to those skilled in the art, except where specifically pointed out to the contrary.

Referring specifically to FIG. 1 of the drawings, for the moment, a first embodiment latch construction is shown in the form of a typical deadbolt construction generally indicated at 20. The deadbolt construction 20 is shown installed in a door generally indicated at 22, the door having a transverse latch opening 24 formed therethrough between an outer door face 26 and an inner door face 28. The transverse latch opening 24, in turn, transversely intersect, a longitudinal latch opening 30 terminating longitudinally forwardly through a vertical door edge 32. Generally, the deadbolt construction 20 includes latch operating means generally indicated at 34 extending partially transversely and partially longitudinally within the door openings 24 and 30 operably connected for reciprocally moving a bolt assembly generally indicated at 36 between extended and retracted positions within a bolt casing assembly generally indicated at 38 and relative to the door edge 32. The latch operating means 34 is comprised of an outside operator assembly generally indicated at 40 and an inside operator assembly generally indicated at 42 operably connected to a latch driving mechanism generally indicated at 44 movable within a stationary frame generally indicated at 46.

More specifically, the outside operator assembly 40 is formed with a typical lock cylinder assembly 48 primarily outwardly of the outer door face 26 radially telescoped by a hardened guard collar and ring assembly 50, and finally by a cover assembly 52. The lock cylinder assembly 48, guard collar and ring assembly 50, and cover assembly 52 are secured transversely inwardly against and within a reinforcing plate 54 primarily within the transverse latch opening 24 by a pair of primary fasteners 56. The outside operator assembly 40 is completed by a primary spindle 58 extending transversely into the transverse latch opening 24 intersecting the longitudinal latch opening 30. The primary spindle 46 is secured rotatable with a lock plug 60 of the lock cylinder assembly 48.

Going to the inner side, the inside operator assembly 42 is formed by a hand operating knob 62 rotatable within a cover assembly 64 which, in turn, encompasses a similar reinforcing plate 66 extending transversely inwardly primarily within the transverse latch opening 24. A backing plate 68 is secured outwardly abutting the reinforcing plate 66 by the heads of the primary fasteners 56, and a pair of secondary fasteners 70 are engaged with a cover assembly 65 and are secured to the outer ends of the primary fasteners 56. The inside operator assembly 42 is completed by a transversely extending secondary spindle 72 outwardly secured rotatable with the hand operating knob 62 and projecting inwardly through the transverse latch opening 24 likewise transversely intersecting the longitudinal latch opening 30.

As best seen in FIGS. 1, 2, 3 and 5 through 7, the latch driving mechanism 44 within the longitudinal latch opening 30 is formed rearwardly by a crank hub 74 transversely rotatable in the stationary frame 46 and having an integral driving crank arm 76 projecting radially upwardly therefrom. The inner ends of the primary and secondary spindles 58 and 72 are telescoped non-rotatable within the crank hub 74 as determined by the mating shapes thereof. An upper end 78 of the driving crank arm 76 is received for limited upward and downward movement within a crank driving hole 80 at a rearward end of a rearward bolt extension 82. As can be clearly seen, limited rotation of the crank hub 74 angling the driving crank arm 76 rearwardly will drive the rearward bolt extension 82 rearwardly and angling the driving crank arm 76 forwardly will drive the rearward bolt extension 82 forwardly.

Figure 6:
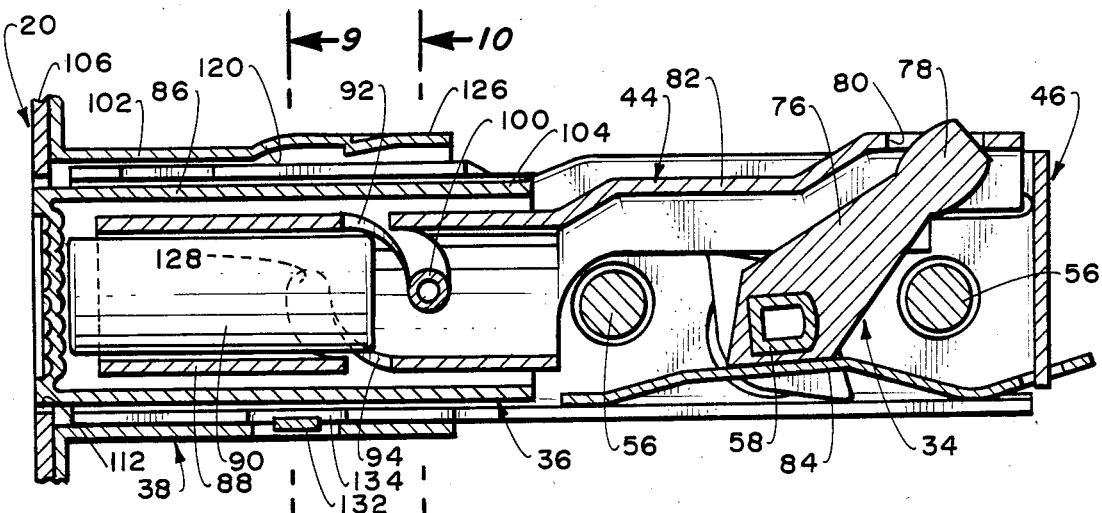
FIG. 6 is a longitudinal vertical sectional view looking in the direction of arrows 6—6 in FIG. 5.
Figure 7:
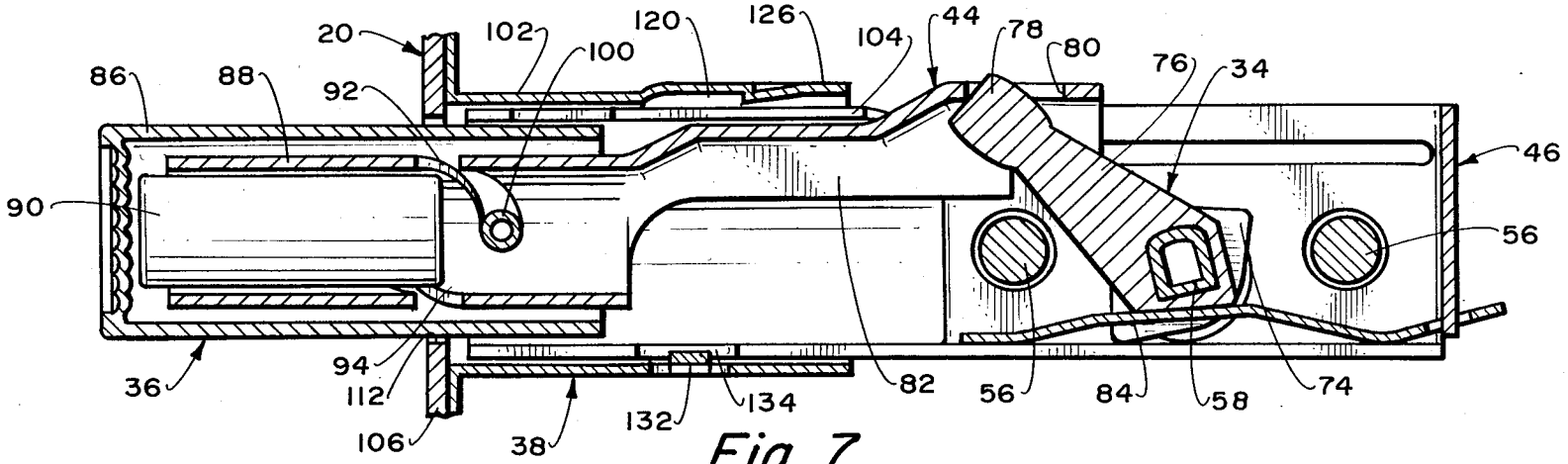
FIG. 7 is longitudinal vertical sectional view similar to FIG. 6, but which the bolt in fully extended position.
Figure 10:
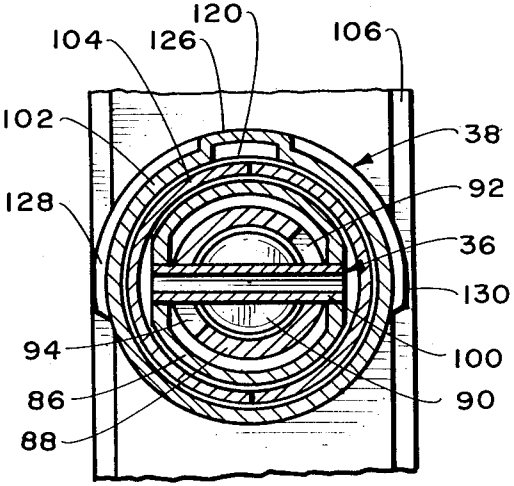
FIG. 10 is a transverse vertical sectional view looking in the direction of the arrows 10—10 in FIG. 6.
Figure 9:
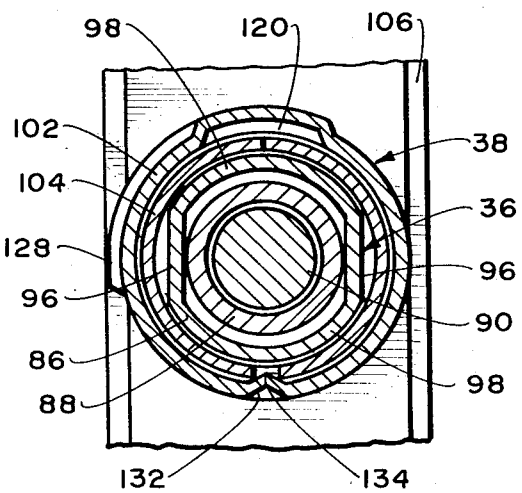
FIG. 9 is a transverse vertical sectional view looking in the direction of the arrows 9—9 in FIG. 6.

Thus, in general and not considering the improvements of the present invention, partial rotation of either of the primary or secondary spindles 58 and 72 by their connected lock cylinder or hand operating knob 48 or 62 will rotate the crank hub 74 and the driving crank arm 76 to longitudinally reciprocate the bolt assembly 36 between an extended position shown, for instance, in FIG. 1 or FIG. 7 and a retracted position as shown in FIG. 6. As is usual, in the retracted position of the bolt assembly 36, such assembly is substantially fully withdrawn within the casing assembly 38, the forward extremity of the bolt assembly usually being substantially even with the door edge 32. Furthermore, it will be noted for the purpose of the later to be described improvements of the present invention, that the transverse axis of the latch operator is the transverse axis of either of the primary or secondary spindles 58 or 72, such spindles constituting the latch operator or operators. Also, it will be noted that the leaf spring 84 defines the forward and rearward positions of the crank hub 74 and the driving crank arm 76 to thereby define the forward and rearward positions of the bolt assembly 36.

Now more particularly to the improvements of the present invention, and referring to FIGS. 1 through 15, the bolt assembly 36 is formed of two parts, a forward bolt part 86 and a rearward bolt part 88. As can be clearly seen, in the particular illustrative embodiment, the forward bolt part 86 is closed at its forward end and open at its rearward end with the rearward bolt part 88 being open at both ends and being telescoped by the forward bolt part, the rearward bolt extension 82 being formed as an integral part of the rearward bolt part and extending longitudinally therefrom to make its connection with the driving crank arm 76 as pointed out above. Furthermore, the rearward bolt part 88, in turn, telescopes a hardened security pin 90 at the forward portion thereof against the closed end of the forward bolt part 86 for the usual purpose of providing the added security against transverse sawing of the bolt parts.

Figure 13:
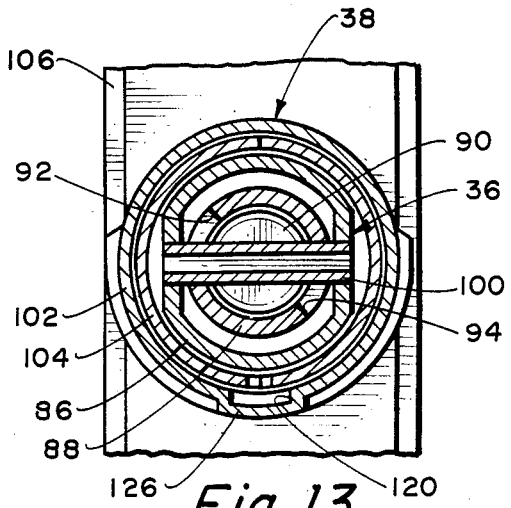
FIG. 13 is a transverse vertical sectional view looking in the direction of the arrows 13—13 in FIG. 11.
Figure 14:
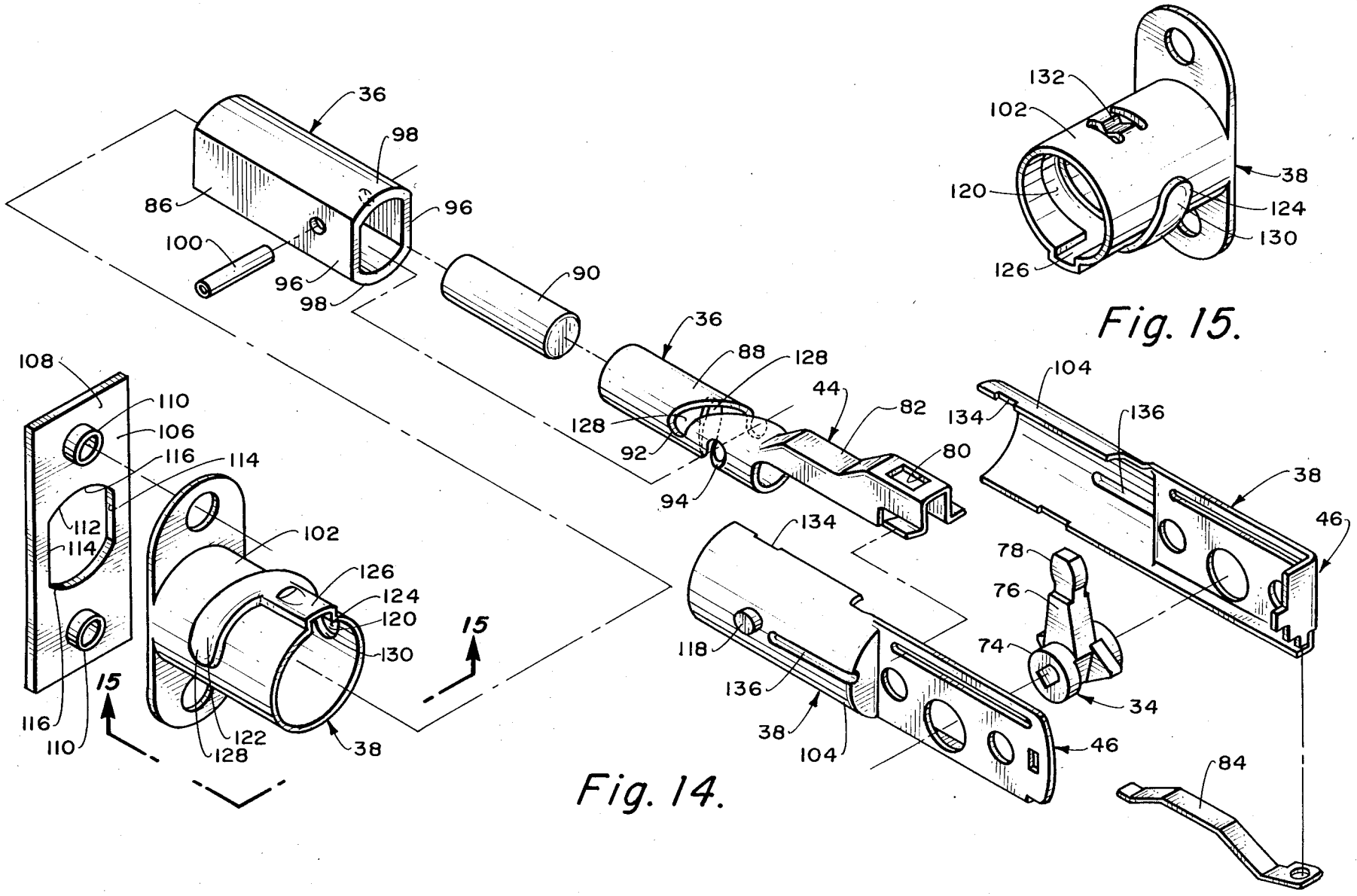
FIG. 14 is an exploded view illustrating the various parts of the latch construction including the backset adjustment of the present invention.

Further to the bolt assembly 36, the rearward bolt part 88 has two, diametrically oppositely commencing, helical slots 92 and 94 formed therein, both being shown in their entireties in FIG. 14, but portions thereof being shown in FIGS. 1, 6, 7, 10, 11 and 13. As can particularly be seen in FIG. 14, the helical slot 92 begins at the near side and extends upwardly and then downwardly to the midpoint of the opposite side. The helical slot 94 starts on the far side as shown in FIG. 14 exactly diametrically opposite the start of the helical slot 92, but passes downwardly and then back upwardly to the near side midpoint finally again exactly diametrically aligned with the termination of the helical slot 92. The result is that a diameter of the rearward bolt part 88 which would lie across between and received in the helical slots 92 and 94 would start, say, forwardly on a diameter of the rearward bolt part and could be moved forwardly exactly within the helical slots at all times describing a diameter, and ultimately complete the extent of the helical slots while still remaining a perfect diameter, but with the ends of the diameter reversed.

As before stated, the rearward bolt part 88 is telescoped by the forward bolt part 86, the rearward bolt part being circular in cross section and the forward bolt part 86 having flat sides 96 and upper and lower curved sides 98. A bolt guide pin 100 is secured transversely across the forward bolt part 86 between the flat side 96 and passing through the opposite helical slots 92 and 94 of the rearward bolt part 88 as shown. Thus, the forward and rearward bolt parts 86 and 88 are retained in assembly, with the hardened security pin 90 forward of the bolt guide pin 100. Further, either bolt part may be rotated relative to the other as guided by the bolt guide pin 100 in the helical slots 92 and 94. Still further, during relative rotation, the forward and rearward bolt parts are either lengthened or reduced in length relative to their longitudinal assembly as exactly guided by the bolt guide pin 100 in the helical slots 92 and 94 between the forward and rearward ends of the helical slots.

As shown in FIGS. 1 through 5, 8, 14 and 15, the casing assembly 38 also includes a forward casing part 102 and a rearward casing part 104 which are likewise telescoped, the forward casing part being rearwardly telescoped over the rearward casing part. Furthermore, the forward casing part 102 terminates forwardly secured against a face plate 106, which therefore forms a part thereof. The rearward casing part 104 rearwardly beyond its telescoping with the forward casing part 102 is formed integrally inward into the previously discussed stationary frame 46. Both the forward casing part 102 and that portion of the rearward casing part 104 which is telescoped with the forward casing part are formed hollow cylindrical or generally circular in cross section, but the face plate 106 which is secured to the forward casing part 102 by upper and lower flanges 108 and fasteners 110, has an aligned opening 112 therethrough which is virtually identical to the outer contour of the forward bolt part 86, that is flat sides 114 separated by upper and lower curve sides 116.

Figure 8:
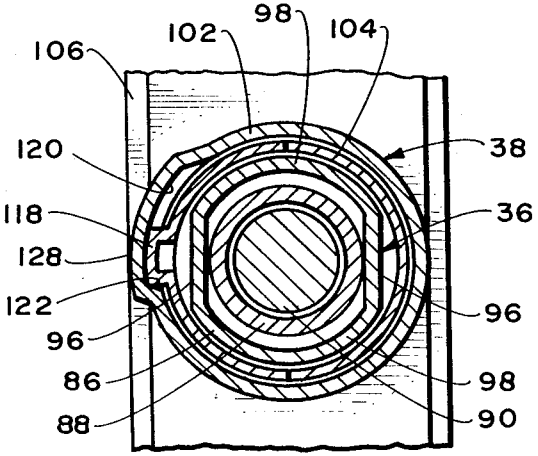
FIG. 8 is a transverse vertical sectional view looking in the direction of the arrows 8—8 in FIG. 3.

Still further, as best seen FIGS. 8 and 14, the rearward casing part 104 has a radially outwardly extending projection 118 which is received in a helical slot 120 of the forward casing part 102. The helical slot 120, which is preferably covered, begins at its forward end 122 at the near side of the forward casing part 102 as shown and passes upwardly over and downwardly to the opposite side or rearward end 124. It will be particularly noted that the projection and slot arrangement in the casing assembly 38 is opposite from that of the bolt assembly 36 so that in this casing assembly, the projection 118 moves, say, rearwardly in the helical slot 120, while the elements move oppositely in the bolt assembly. Further, the helical slot 120 may be formed with an intermediate entrance part 126 which may be used during assembly or the projection 118 with the helical slot 120, and then may be formed as shown in FIG. 14 to retain such assembly.

As best seen in FIGS. 6, 11, 14 and 15, the helical slots 92 and 94 on the bolt have the forward bolt parts 102 which are preferably formed with radially flat end portions, a forward flat end portion 128 on each. Also, the helical slot 120 of the casing has a rearward end 124 which is preferably formed with a radially flat end portion 130. In other words, as the helical slot or slots approach their termination at their particular end where the radial flat exists, instead of continuing the helical path to termination, the slot turns directly to straight radial extension for the last short section. The purpose of these preferred radially flat end portions 128 and 130 of the helical slots is to prevent certain malfunctions, all of which will be described below.

In joining of the bolt assembly 36 and the casing assembly 38 in a mutually workable backset adjustment relationship as illustrated, the forward and rearward bolt parts 86 and 88 are telescoped and the forward and rearward casing parts 102 and 104 are telescoped with both in either their minimum or maximum backset adjustment and with the forward bolt part 86 projecting forwardly through the face plate 106 of the forward casing part. Furthermore, the latch construction may be in either an extended position as shown, for instance, in FIGS. 1 and 2, or a retracted position as shown, for instance, in FIGS. 3, 4 and 5. The backset adjustment construction of the present invention will operate efficiently in either extended or retracted positions.

Assuming that the latch construction is in minimum backset position as shown in FIGS. 1 through 10, in the bolt assembly 36, the bolt guide pin 100 will be at the rearward ends of the helical slots 92 and 94 as shown. Furthermore, in the casing assembly 38, the projection 118 will be at the forward end 124 of the helical slot 120. The forward bolt part 86 of the bolt assembly 36 projects forwardly into or forwardly beyond the face plate 106 of the forward casing part 102 in casing assembly 38. In view of the fact that the forward bolt part 86 of the bolt assembly 36 has the flat sides 96 and the forward casing part 102 of the casing assembly 38 has its opening through the face plate 106 with its flat sides 114, and since these mutal flat sides must always remain in engagement both in extended and retracted positions, both of the bolt and casing assemblies 36 and 38 must always be in the same backset adjusted position, either the minimum backset position or the extended or maximum backset position. In this case, they are both in the minimum backset position and will operate between extended and retracted position as shown in FIGS. 1 through 10.

Figure 11:
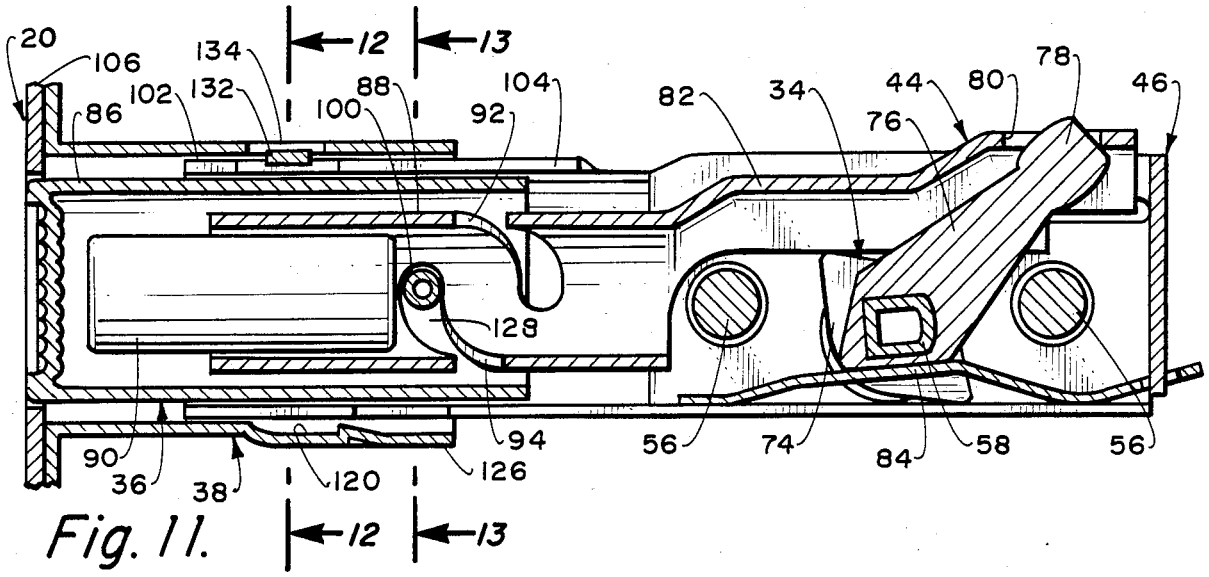
FIG. 11 is a longitudinal vertical sectional view similar to FIG. 6, but with the backset adjustment shown in maximum backset adjustment.
Figure 12:
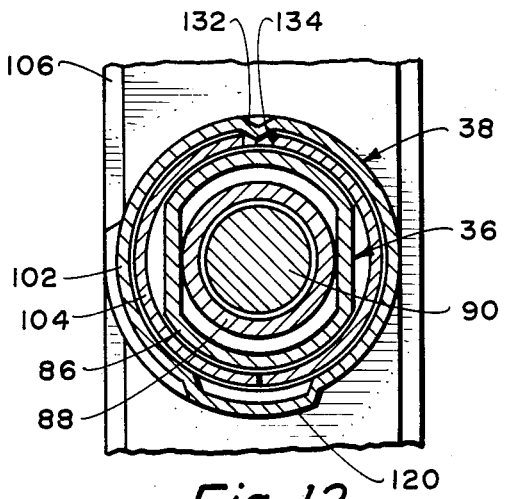
FIG. 12 is a transverse vertical sectional view looking in the direct of the arrows 12—12 in FIG. 11.

Now, if it is desired to alter the backset position of the latch construction from the minimum backset position as shown in FIGS. 1 through 10 to the maximum or increased backset position as shown in FIGS. 11 through 13, prior to installing the deadbolt construction 20 in the door 22, the forward casing part 102 of the casing assembly 38 is grasped in one hand and the rearward casing part 104 of the casing assembly 38 or the stationary frame 46 is grasped in the other hand.. The two are rotated one relative to the other, in this case, with the particular embodiment, one half turn. The result is that the projection 118 of the rearward casing part 104 which is at the forward end 122 of the helical path of the helical slot both longitudinally rearwardly and rotatably to finally arrive at the rearward end 124 of the helical slot 120 in the forward casing part, thereby lengthening out the casing assembly 38 as shown in FIGS. 11 through 13. At the same time, due to the flat sided engagement between the bolt and casing assemblies 36 and 38 at the face plate 106 of the forward casing part 102, the forward part 86 of the bolt assembly 36 will also rotate with the forward casing part 102 of the casing assembly 38. This means that the forward bolt part 86 will move the bolt guide pin 100 from the rearward ends of the helical slots 92 and 94 in the rearward bolt part 88 to the forward ends of such slots, thereby also lengthening out the bolt assembly 36 the same amount as the casing assembly 38, as shown in FIGS. 11 and 13.

Also, and keeping in mind it is from minimum to maximum backset, due to the previously discussed rearward flat end portion 130 of the helical slot 120 in the forward casing part 102, the simultaneous movement in such adjustment of the bolt and casing assemblies 36 and 38 will be guarded against any possibility of misalignments between the forward bolt part 86, if it is in its retracted position, and the forward casing part 102. With the rearward flat end portion 130 provided on the casing helical slot 120 at initiation of adjustment movement, the casing assembly 38 will not initially begin to adjust for lengthening the same, whereas the bolt assembly 36 will immediately commence longitudinal adjusting movement. Although the casing assembly 38 will start such longitudinal adjustment after a short delay, this means that the forward bolt part 86 is always ahead of the face plate 106 of the forward casing part 102, so that there never can be catching interference of any type which could destroy the working of the backset adjustment of the present invention. This same guarding against interference is supplied in the movement from maximum backset to minimum backset by the forward flat end portions 138 of the helical slots 92 and 94 on the rearward bolt part 88, only in this arrangement, the bolt remains temporarily stationary, while the casing begins to move rearwardly.

It has been previously pointed out that the backset dimension of latch construction in the distance from the transverse axis of the latch operator or operators longitudinally forwardly to the forward extremities of the casing assembly. With the particular latch construction illustrated, that is the deadbolt construction 20, this backset dimension would be calculated from the transverse axis of the primary and secondary spindles 56 and 72 longitudinally forwardly to the front or door edge surface of the face plate 106 on the casing assembly 38. In modern day industry, the smaller or minimum standard backset measurement is $2\frac{3}{8}$ inches and the larger or maximum standard backset measurement is $2\frac{3}{4}$ inches.

As hereinbefore pointed out, with the particular embodiment shown, the backset adjustment between minimum and maximum is carried out in one half turn of the casing assembly 38, which likewise adjusts the bolt assembly 36 a like amount, and moving in this one half turn. In order to define the ends of the backset adjustment, a spring member 132 may be formed on the forward casing part 102 of the casing assembly 38 which engages radially inward with somewhat diametrically opposite slots 134. These slots 134 are axially and diametrically separated the longitudinal distance of the extension of the helical slot 120 on the forward casing part 102. In this manner, when the forward and rearward casing parts 102 and 104 reach either limit of longitudinal movement in their longitudinal adjustment, the spring member 132 will be resiliently snap into the particular aligned slot 134 so as to define the limit of movement.

Furthermore, if it is desired to limit the backset adjustment to the extended position of the bolt assembly 36 relative to the casing assembly 38 in order to avoid the possibility of slight misalignment problems, this can be done by the installation of anti-adjustment projection or projections 136 as shown in phantom lines in FIG. 1 and full lines in FIG. 14. These anti-adjustment projections 136 may be formed on the sides of the rearward casing part 104 as illustrated so as to project radially inwardly and just radially out from the forward bolt part 86 of the bolt assembly 36. Furthermore, these anti-adjustment projections will extend along the rearward bolt extension 82 and stop short of the bolt assembly 36 when the bolt assembly is in its extended position. Thus, when the bolt assembly 36 is in its retracted position, the backset adjustment can never be made since the anti-adjustment projections 136 will interfere with relative rotation between various parts in their extension against the forward bolt part 86 and the flat sides 96 thereof. However, when the forward bolt part 86 is extended as shown in FIG. 1, the forward projection of the forward bolt part 86 will remove it from interference by the anti-adjustment projections 136 and permit the usual backset adjustment as desired.

Figure 16:
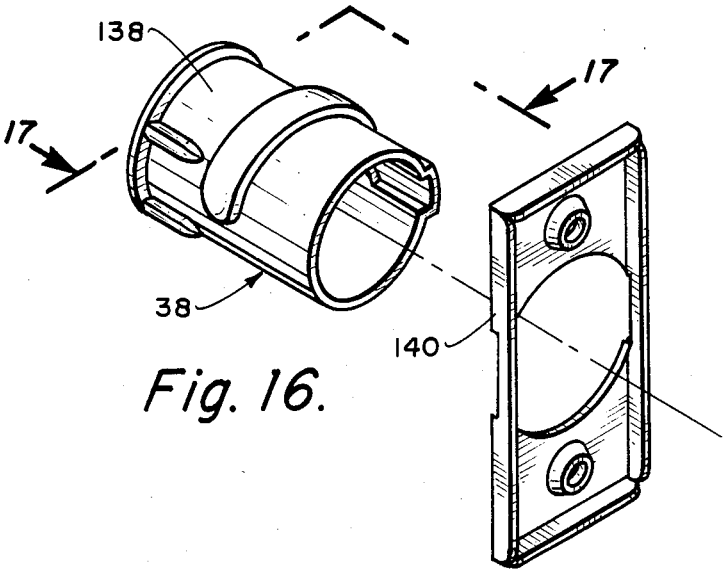
FIG. 16 is a perspective view showing an alternative form of the forward part of the casing somewhat similar to FIG. 15.
Figure 17:
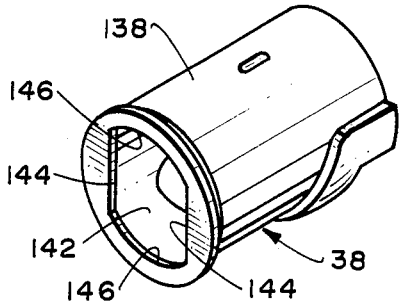
FIG. 17 is a perspective view of the forward part of the casing looking along the arrows 17—17 in FIG. 16.

A second embodiment of the latch construction is shown in FIGS. 16 and 17. The only difference is that a forward casing part 138 of the casing assembly 38 is formed separable from its face plate 140. Furthermore, the forward end of the forward casing part 138 is formed with an opening 142 having flat sides 144 and curved upper and lower sides 146. This shifts the control of the backset adjustment from the face plate 140 to a direct integral part of the forward casing part 138. This merely provides a slightly different form and otherwise the backset adjustment is identically the same.

According to the present invention, therefrom, a latch helical backset adjustment is provided preferably in the form of a deadbolt construction 20 which has helical slots and projections which determine the backset adjustment setting. The backset adjustment may be from minimum to maximum or from maximum to minimum, and due to the particular helical slots providing the same, may be accomplished in either extended or retracted position of the latch bolt or deadbolt construction. Furthermore, the backset adjustment is accomplished merely by grasping opposite ends of the latch bolt or deadbolt construction in opposite hands and twisting or rotating one over the other. The casing assembly 38, due to its unique connection with the bolt assembly 36 will, in this manner, accomplish the entire adjustment. Furthermore, the resulting backset adjustment, again, whether from minimum to maximum or maximum to minimum, will be accomplished in an efficient manner without the requirement of unusual skills.

Although the principles of the present invention have been illustrated in particular embodiments of latch constructions, it is not intended to limit such principles of the constructions alone, since the same principles are readily applicable to various other forms of latch constructions. Thus, the principles of the present invention should be broadly construed and not limited beyond the specific limitations set forth in the appended claims including the patent equivalents thereof.

I claim:

1. In a latch construction for mounting in doors and the like of a type having a bolt longitudinally reciprocal in a normally stationary casing between a forward extended position projecting from the casing and a rearward retracted position substantially fully within the casing, latch operating means forwardly operably connected to said bolt and rearwardly operably connected to an operator thereof, said operating means operator being movable about a transverse axis actuating said actuating means to reciprocate said bolt, longitudinal distance between forward extremity of said casing and said operator axis constituting backset; the improvements including: said bolt and said casing each being comprised of relatively longitudinally movable forward and rearward parts; a substantially helical slot on one of said parts engaged by a projection on the other of said parts of each of said bolt and casing, said slot and projection providing helical longitudinal movement for each of a determined same amount between a forward backset and a rearward backset; interconnection means between certain of said bolt parts and certain of said casing parts for requiring substantially the same helical longitudinal movement of one upon such movement of the other; said bolt being reciprocal relative to said casing in either of said forward and rearward backsets.

2. In a latch construction as defined in claim 1 in which said casing has said helical slot and projection engaged at at least one side and said bolt has said helical slot and projection engaged at opposite sides.

3. In a latch construction as defined in claim 1 in which said bolt and said casing are moved between said backset adjustments in said helical longitudinal movement of twisting said parts one on the other of at least one of said casing and bolt.

4. In a latch construction as defined in claim 1 in which said casing forward and rearward parts are telescoped and said bolt forward and rearward parts are telescoped.

5. In a latch construction as defined in claim 1 in which said casing forward and rearward parts are telescoped and said bolt forward and rearward parts are telescoped, said casing forward part having said helical slot formed therein and said casing rearward part having said projection formed thereon, said bolt forward part having said projection formed thereon and said bolt rearward part having said slot formed therein.

6. In a latch construction as defined in claim 1 in which said helical longitudinal movement of said casing and bolt between said forward backset and said rearward backset is approximately one hundred eighty degrees to produce said movement.

7. In a latch construction as defined in claim 1 in which said casing helical slot at its rearward end of movement is formed radially flat for a short distance toward transverse of said casing so that in movement of said casing from less toward greater backsets always begins bolt movement slightly ahead of casing movement; and in which said bolt helical slot at its forward end of movement is formed radially flat for a short distance toward transverse of said bolt so that in movement of greater toward lesser backsets the casing movement is slightly ahead of bolt movement.

8. In a latch construction as defined in claim 1 in which anti-adjustment projection means is formed on said casing projecting toward said bolt so that said bolt is prevented by said anti-adjustment projection means when said latch is in said retracted position form being adjusted between said backset positions and is permitted said adjustments when is said extended position.

9. In a latch construction as defined in claim 1 in which said casing has resiliently urged stops between said casing parts engagable at either backset position for positioning said parts at said backset positions.

10. In a latch construction as defined in claim 1 in which said casing has said helical slot and projection engaged at at least one sie and said bolt has said helical slot and projection engaged at opposite sides; and in which said bolt and said casing are moved between said backset adjustments in said helical longitudinal movement of twisting said parts one on the other of at least one of said casing and bolt.

11. In a latch construction as defined in claim 1 in which said casing forward and rearward parts are telescoped and said bolt forward and rearward parts are telescoped; and in which said bolt and said casing are moved between said backset adjustments in said helical longitudinal movement by twisting said parts one on the other of at least one of said casing and bolt.

12. In a latch construction as defined in claim 1 in which said casing forward and rearward parts are telescoped and said bolt forward and rearward parts are telescoped, said casing forward part having said helical slot formed therein and said casing rearward part having said projection formed thereon, said bolt forward part having said projection formed thereon and said bolt rearward part having said slot formed therein; and in which said bolt and said casing are moved between said backset adjustments in said helical longitudinal movement by twisting said parts one on the other of at least one of said casing and bolt.

13. In a latch construction as defined in claim 1 in which said casing forward and rearward parts are telescoped and said bolt forward and rearward parts are telescoped; in which said bolt and said casing are moved between said backset adjustments in said helical longitudinal movement by twisting said parts one on the other of at least one of said casing and bolt; and in which said helical longitudinal movement of said casing and bolt between said forward backset and said rearward backset is approximately one hundred eighty degrees to produce said movement.

14. In a latch construction as defined in claim 1 in which said casing forward and rearward parts are telescoped and said bolt forward and rearward parts are telescoped; in which said bolt and said casing are moved between said backset adjustments in said helical longitudinal movement by twisting said parts one on the other of at least one of said casing and bolt; in which said casing helical slot at its rearward end of movement is formed radially flat for a short distance toward transverse of said casing so that in movement of said casing from less toward greater backsets always begins bolt movement slightly ahead of casing movement; and in which said bolt helical slot at its forward end of movement is formed radially flat for a short distance toward transverse of said bolt so that in movement of greater toward lesser backsets the casing movement is slightly ahead of bolt movement.

15. In a latch construction as defined in claim 1 in which said casing forward and rearward parts are telescoped and said bolt and rearward parts are telescoped; in which said bolt and said casing are moved between said backset adjustments in said helical longitudinal movement by twisting said parts one on the other of at least one of said casing and bolt; and in which anti-adjustment projection means is formed on said casing projecting toward said bolt so that said bolt is prevented by said anti-adjustment projection means when said latch is in said retracted position from being adjusted between said backset positions and is permitted said adjustments when in said extended position.

16. In a latch construction as defined in claim 1 in which said casing forward and rearward parts are telescoped and said bolt forward and rearward parts are telescoped; in which said bolt and said casing are moved between said backset adjustments in said helical longitudinal movement by twisting said parts one on the other of at least one of said casing and bolt; and in which said casing has resiliently urged stops between said casing parts engageable at eigher backset position for positioning said parts at said backset positions.

17. In a latch construction as defined in claim 1 in which said casing forward and rearward parts are telescoped and said bolt forward and rearward parts are telescoped; in which said bolt and said casing are moved between said backset adjustments in said helical longitudinal movement by twisting said parts one on the other of at least one of said casing and bolt; in which said helical longitudinal movement of said casing and bolt between said forward backset and said rearward backset is approximately one hundred eighty degrees to produce said movement; in which said casing helical slot at its rearward end of movement is formed radially flat for a short distance toward transvese of said casing so that in movement of said casing from less toward greater backsets always begins bolt movement slightly ahead of casing movement; and in which said bolt helical slot at its forward end of movement is formed radially flat for a short distance toward transverse of said bolt so that in movement of greater toward lesser backsets the casing movement is slightly ahead of bolt movement.

18. In a latch construction as defined in claim 1 in which said casing forward and rearward parts are telescoped and said bolt forward and rearward parts are telescoped; in which said bolt and said casing are moved between said backset adjustments in said helical longitudinal movement by twisting said parts one on the other of at least one of said casing and bolt; in which said helical longitudinal movement of said casing and bolt between said forward backset and said rearward backset is approximately one hundred eighty degrees to produce said movement; and in which said casing has resiliently urged stops between said casing parts engagable at either backset position for positioning said parts at said backset positions.

19. In a latch construction as defined in claim 1 in which said casing forward and rearward parts are telescoped and said bolt forward and rearward parts are telescoped; in which said bolt and said casing are moved between said backset adjustments in said helical longitudinal movement by twisting said parts one on the other of at least one of said casing and bolt; in which said helical longitudinal movement of said casing and bolt between said forward backset and said rearward backset is approximately one hundred eighty degrees to produce said movement; in which said casing helical slot at its rearward end of movement is formed radially flat for a short distance toward transverse of said casing so that in movement of said casing from less toward greater backsets always begins bolt movement slightly ahead of casing movement; in which said bolt helical slot at its forward end of movement is formed radially flat for a short distance toward transverse of said bolt so that in movement of greater toward lesser backsets the casing movement is slightly ahead of bolt movement; and in which said casing has resiliently urged stops between said casing parts engageable at either backset position for positioning said parts of said backset positions.

20. In a latch construction as defined in claim 1 in which said casing forward and rearward parts are telescoped and said bolt forward and rearward parts are telescoped; in which said bolt and said casing are moved between said backset adjustments in said helical longitudinal movement by twisting said parts one on the other of at least one of said casing and bolt; and in which said casing has said helical slot and projection engaged at at least one side and said bolt has said helical slot and projection engaged at opposite sides.

21. In a latch construction as defined in claim 1 in which said interconnection means between said certain of said bolt parts and said certain of said casing parts includes peripheral formation of certain of said bolt and casing parts permitting longitudinal movement therebetween but preventing rotational movement therebetween.

22. In a latch construction as defined in claim 1 in which said interconnection means between said certain of said bolt parts and said certain of said casing parts includes a forward outer part of said bolt and a forward outer part of said casing being formed of uniform outer peripheral dimension so that said bolt part will move forward and rearward in said casing part but will not rotate relative to said casing part.

* * * * *